US011692708B1

(12) United States Patent
Sampath et al.

(10) Patent No.: US 11,692,708 B1
(45) Date of Patent: Jul. 4, 2023

(54) COMBUSTOR LINER HAVING DILUTION OPENINGS WITH SWIRL VANES

(71) Applicant: General Electric Company, Schenectady, NY (US)

(72) Inventors: Karthikeyan Sampath, Bengaluru (IN); Perumallu Vukanti, Bengaluru (IN); Ajoy Patra, Bengaluru (IN); Pradeep Naik, Bengaluru (IN); Hiranya Nath, Bengaluru (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/809,379

(22) Filed: Jun. 28, 2022

(30) Foreign Application Priority Data

Feb. 18, 2022 (IN) ..... 202211008588

(51) Int. Cl.
*F23R 3/14* (2006.01)
*F23R 3/06* (2006.01)

(52) U.S. Cl.
CPC ..... *F23R 3/14* (2013.01); *F23R 3/06* (2013.01); *F23R 2900/03044* (2013.01)

(58) Field of Classification Search
CPC .... F23R 3/045; F23R 3/06; F23R 3/14; F23R 2900/03044; F23D 14/24
See application file for complete search history.

(56) References Cited

U.S. PATENT DOCUMENTS 2,916,878 A * 12/1959 Wirt ..... F23R 3/04 60/759
3,872,664 A * 3/1975 Lohmann ..... F23R 3/346 431/9
4,590,769 A * 5/1986 Lohmann ..... F23R 3/045 60/752
5,331,805 A * 7/1994 Myers ..... F23R 3/14 60/804
5,590,530 A * 1/1997 Owen ..... F23R 3/045 60/752
9,057,523 B2 6/2015 Cunha et al.
9,625,151 B2 4/2017 Jause et al.
9,851,105 B2 12/2017 Propheter-Hinckley et al.
9,976,743 B2 5/2018 Propheter-Hinckley et al.
(Continued)

FOREIGN PATENT DOCUMENTS

EP 2963346 B1 5/2017

*Primary Examiner* — Jason H Duger
(74) *Attorney, Agent, or Firm* — Venable LLP; Edward A. Kmett; Michele V. Frank

(57) ABSTRACT

A combustor liner for a gas turbine includes a liner that at least partially defines a combustion chamber, and that a plurality of dilution openings therethrough. Each dilution opening includes an outer wall defining an outer perimeter of the dilution opening and defining a dilution opening centerline axis through the dilution opening. A plurality of swirl vanes extend from the outer wall into a dilution airflow passage that extends through the dilution opening. Each of the plurality of swirl vanes extends from the outer wall into the dilution airflow passage at a respective swirl vane angle with respect to the outer wall. The plurality of swirl vanes are arranged in a successive arrangement about the outer wall, and successive respective ones of the plurality of swirl vanes extend from the outer wall at a different swirl vane angle.

20 Claims, 9 Drawing Sheets

(56) References Cited

U.S. PATENT DOCUMENTS

| | | | | |
|---|---|---|---|---|
| 10,167,781 | B2 | 1/2019 | Toon | |
| 10,309,314 | B2 | 6/2019 | Hoke et al. | |
| 10,408,453 | B2 | 9/2019 | Mongillo et al. | |
| 11,137,140 | B2 | 10/2021 | Mongillo et al. | |
| 2003/0046934 | A1* | 3/2003 | Sherwood | F23R 3/04 60/722 |
| 2010/0223930 | A1* | 9/2010 | Chila | F23R 3/04 60/752 |
| 2010/0242483 | A1* | 9/2010 | Snyder | F23R 3/06 60/757 |
| 2011/0048024 | A1* | 3/2011 | Snyder | F23R 3/50 60/754 |
| 2011/0120134 | A1* | 5/2011 | Hoke | F23R 3/50 60/754 |
| 2014/0165578 | A1* | 6/2014 | Burd | F23R 3/28 60/748 |
| 2015/0003478 | A1* | 1/2015 | Kristoffersen | H04L 43/0858 370/503 |
| 2016/0186998 | A1* | 6/2016 | Kostka, Jr. | F23R 3/045 415/115 |
| 2017/0268784 | A1* | 9/2017 | Crawley | F23R 3/34 |
| 2019/0353351 | A1 | 11/2019 | Bunel et al. | |
| 2020/0208840 | A1* | 7/2020 | Sauer | B22F 5/10 |

* cited by examiner

COMBUSTOR LINER HAVING DILUTION OPENINGS WITH SWIRL VANES

CROSS REFERENCE TO RELATED APPLICATIONS

The present application claims the benefit of Indian Patent Application No. 202211008588, filed on Feb. 18, 2022, which is hereby incorporated by reference herein in its entirety.

TECHNICAL FIELD

The present disclosure relates to a combustor liner having dilution. More particular, the present disclosure relates to a dilution opening having swirl vanes.

BACKGROUND

In conventional gas turbine engines, it has been known to provide a flow of dilution air into a combustion chamber downstream of a primary combustion zone. Conventionally, a combustor includes a liner that defines a combustion chamber. The liner may include dilution holes that provide a flow of air (i.e., a dilution jet) from a passage surrounding the liner into the combustion chamber. Some applications have been known to use circular holes for providing the dilution airflow to the combustion chamber. The flow of air through the circular dilution holes in the conventional combustor mixes with combustion gases within the combustion chamber to provide quenching of the combustion gases. High temperature regions seen behind the dilution jet (i.e., in the wake region of the dilution jet) are associated with high Nitrous Oxide ($NO_x$) formation. In addition, the circular dilution hole does not spread the flow of dilution air laterally, thereby, creating high temperatures in-between dilution holes that also contribute to higher $NO_x$ formation.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1:
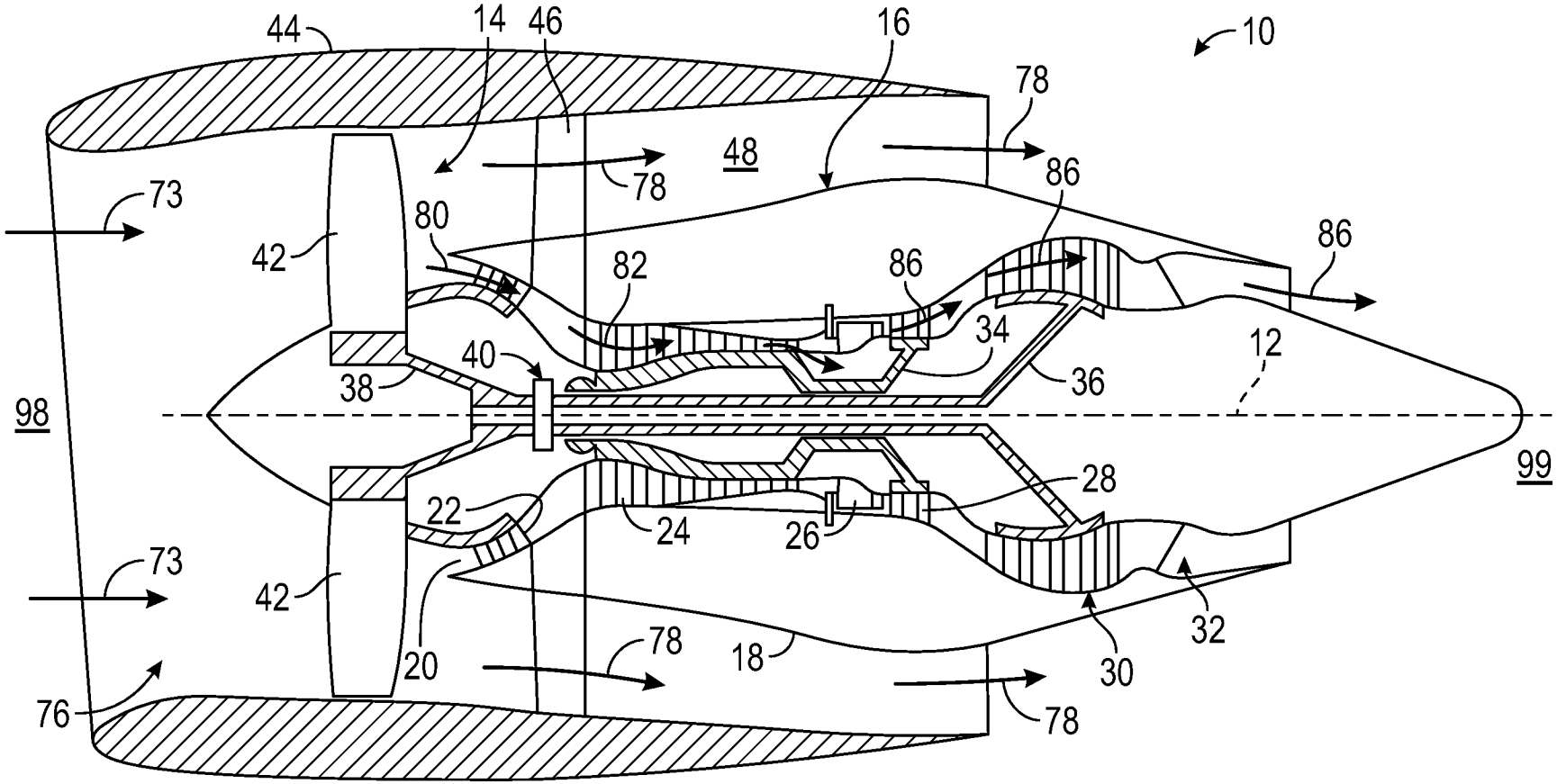
FIG. 1 is a schematic partial cross-sectional side view of an exemplary high by-pass turbofan jet engine, according to an aspect of the present disclosure.

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

In a combustion section of a turbine engine, airflow in an outer passage surrounding a combustor liner is diverted through dilution holes in the combustor liner and into a combustion chamber to be used as dilution air. One purpose of the dilution air is to quench (i.e., cool) combustion gases within the combustion chamber before the gases enter a turbine section downstream of the combustion chamber. At a leading edge of the dilution hole, separation of the airflow occurs such that very little of the dilution air adheres to the upstream side of the dilution hole. The separation can also cause hot gas ingestion into the dilution flow passage within the dilution hole, thereby reducing the life of the liner. At the trailing edge of the dilution hole along the inner surface of the liner (i.e., inside the combustion chamber), a wake forms in the dilution airflow behind the dilution hole. The wake results in a higher temperature behind the dilution airflow, which causes higher $NO_x$ formation, and which reduces the life of the combustor liner.

The present disclosure provides a way to fill in the wake region at the downstream side of the dilution hole with dilution air, thereby reducing the $NO_x$ emissions and improving the durability of the liner. According to the present disclosure, a dilution opening includes a plurality of swirl vanes arranged about an outer wall of the dilution opening. Respective ones of the plurality of swirl vanes are arranged at different swirl vane angles with respect to a wall of the dilution opening and with respect to one another. The respectively different swirl vane angles provide a preferential swirled flow of the dilution air through the dilution opening to fill-in the wake region at the downstream side of the dilution opening. Specific swirl vane angles of each of the swirl vanes may be selected based on the desired preferential swirled flow, and based on the incoming flow of air through the outer flow passage.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine-based turbine engines, industrial turbine engines, and auxiliary power units. As shown in FIG. 1, engine 10 has an axial centerline axis 12 that extends therethrough from an upstream end 98 to a downstream end 99 for reference purposes. In general, the engine 10 may include a fan assembly 14 and a core engine 16 disposed downstream from the fan assembly 14.

The core engine 16 may generally include an outer casing 18 that defines an annular inlet 20. The outer casing 18 encases, or at least partially forms, in serial flow relationship, a compressor section (22/24) having a low pressure (LP) compressor 22 and a high pressure (HP) compressor 24, a combustor 26, a turbine section (28/30) including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration.

As shown in FIG. 1, the fan assembly 14 includes a plurality of fan blades 42 that are coupled to, and that extend radially outwardly from, the fan shaft 38. An annular fan casing or nacelle 44 circumferentially surrounds the fan assembly 14 and/or at least a portion of the core engine 16. The nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
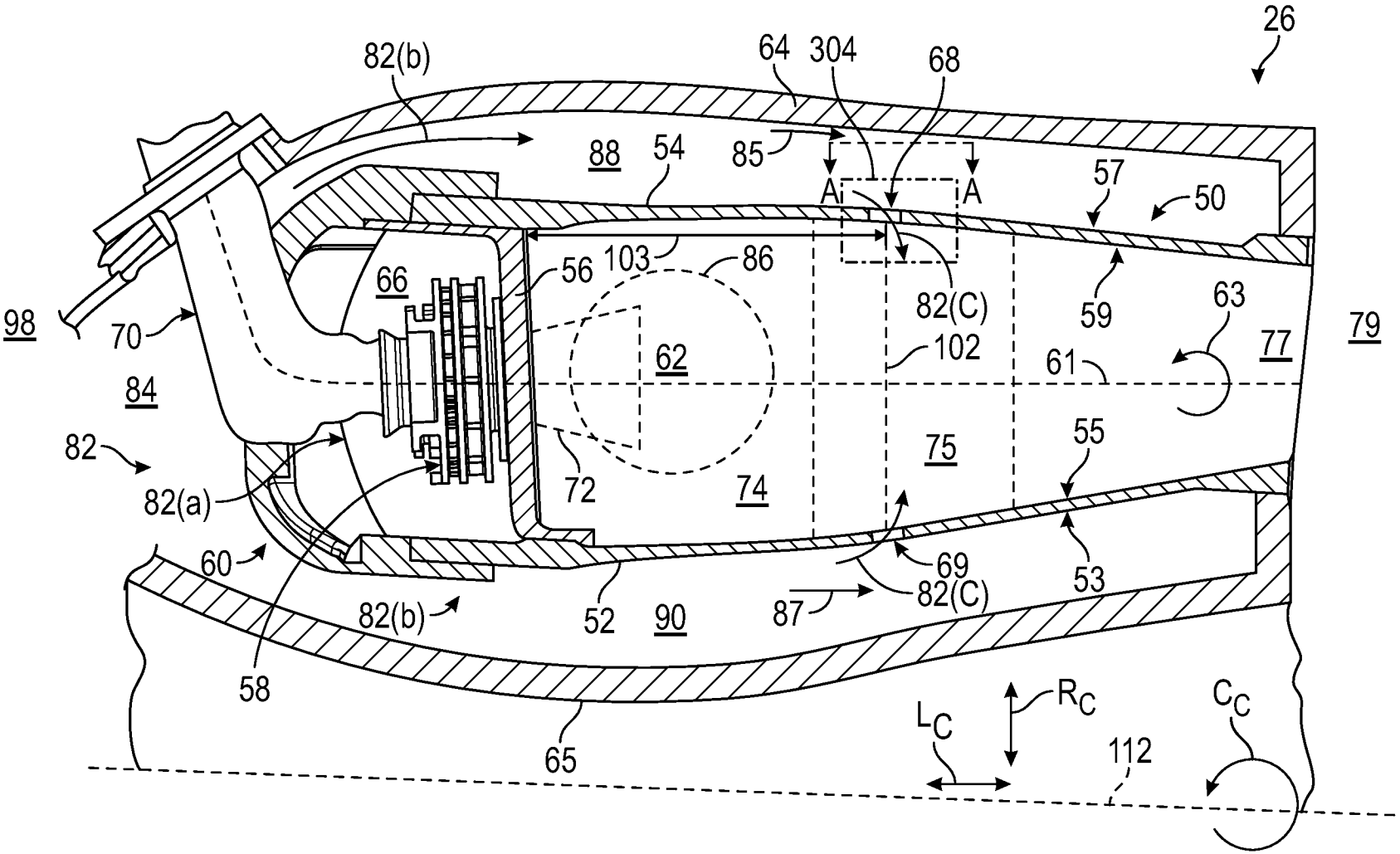
FIG. 2 is a partial cross-sectional side view of an exemplary combustor, according to an aspect of the present disclosure.

FIG. 2 is a cross-sectional side view of an exemplary combustor 26 of the core engine 16 as shown in FIG. 1. The exemplary combustor 26 shown in FIG. 2 is depicted as an annular type combustor that includes both an inner liner and an outer liner that each extend circumferentially about a combustor centerline axis, but the present disclosure can be implemented in other types of combustors, including, as one example, can-type combustors. As shown in FIG. 2, the combustor 26 may generally include a combustor liner 50 having an inner liner 52 and an outer liner 54, and a dome assembly 56, together defining a combustion chamber 62. Both the inner liner 52 and the outer liner 54 may extend circumferentially about a combustor centerline axis 112, which may correspond to the engine axial centerline axis 12. While FIG. 2 depicts a single layer liner for both the inner liner 52 and the outer liner 54, other types of liners, such as multi-layer liners, may be included instead. The inner liner 52 and the outer liner 54 are connected to a cowl 60, and a pressure plenum 66 is defined between the cowl 60, the inner liner 52, the outer liner 54, and the dome assembly 56.

As shown in FIG. 2, the inner liner 52 is encased within an inner casing 65 and the outer liner 54 is encased within an outer casing 64. An outer flow passage 88 is defined between the outer liner 54 and the outer casing 64, and an inner flow passage 90 is defined between inner liner 52 and the inner casing 65. Both the outer casing 64 and the inner casing 65 may extend circumferentially about the combustor centerline axis 112. A cold surface side 53 of the inner liner 52 is adjacent to the inner flow passage 90, and a hot surface side 55 of the inner liner 52 is adjacent to the combustion chamber 62. Similarly, a cold surface side 57 of the outer liner 54 is adjacent to the outer flow passage 88, and a hot surface side 59 of the outer liner 54 is adjacent to the combustion chamber 62. The inner liner 52 and the outer liner 54 may extend from the dome assembly 56 to a turbine nozzle 79 at an entry to the HP turbine 28 (FIG. 1), thus, at least partially defining a hot gas path between the combustor liner 50 and the HP turbine 28. More particularly, the combustion chamber 62 may, more specifically, define a primary combustion zone 74 at which an initial chemical reaction of a fuel-oxidizer mixture 72 occurs to generate combustion gases 86, and/or where recirculation of the combustion gases 86 may occur before the combustion gases 86 flow further downstream to a dilution zone 75. At the dilution zone 75, the combustion gases 86 mix with dilution air 82(*c*) before flowing to a secondary combustion zone 77 and into a turbine nozzle 79 at an entry to the HP turbine 28 and the LP turbine 30. As will be described in more detail below, the plurality of dilution openings 68 and the plurality of dilution openings 69 provide a flow of dilution air 82(*c*) therethrough and into the combustion chamber 62. The flow of dilution air 82(*c*) can thus be utilized to provide quenching of the combustion gases 86 in the dilution zone 75 downstream of the primary combustion zone 74 so as to cool the flow of combustion gases 86 entering the turbine section (28/30).

During operation of the engine 10, as shown in FIGS. 1 and 2 collectively, a volume of air, as indicated schematically by arrows 73, enters the engine 10 from the upstream end 98 through an associated nacelle inlet 76 of the nacelle 44 and/or fan assembly 14. As the air 73 passes across the fan blades 42, a portion of the air 73 is directed or routed into the bypass airflow passage 48 as a bypass airflow 78, while another portion of the air 73 is directed or routed into the LP compressor 22 as a compressor inlet air 80. The compressor inlet air 80 is progressively compressed as it flows through the LP compressor 22 and the HP compressor 24 towards the combustor 26. As shown in FIG. 2, compressed air 82 flows into and pressurizes a diffuser cavity 84. A first portion of the compressed air 82, as indicated schematically by arrows 82(*a*), flows from the diffuser cavity 84 into the pressure plenum 66, where it is mixed by mixer assembly 58 with fuel provided by a fuel nozzle assembly 70. A fuel-oxidizer mixture 72 is then ejected into the combustion chamber 62 by the mixer assembly 58 in a mixer swirl direction 63 about a mixer assembly centerline axis 61. The fuel-oxidizer mixture 72 is ignited and burned to generate the combustion gases 86 within the primary combustion zone 74 of the combustion chamber 62. Typically, the LP compressor 22 and the HP compressor 24 provide more compressed air 82 to the diffuser cavity 84 than is needed for combustion. Therefore, a second portion of the compressed air 82, as indicated schematically by arrows 82(*b*), may be used for various purposes other than combustion. For example, as shown in FIG. 2, compressed air 82(*b*) may be routed into the outer flow passage 88 and generally flows downstream in a flow direction 85 within the outer flow passage 88. Similarly, a portion of the compressed air 82(*b*) may be routed into the inner flow passage 90 and generally flows downstream in a flow direction 87 within the inner flow passage 90. A portion of the compressed air 82(*b*) passing over the dilution openings 68 and passing over the dilution openings 69, shown schematically by arrows 82(*c*), may be routed through the plurality of dilution openings 68 and through the plurality of dilution openings 69, into the dilution zone 75 of combustion chamber 62, to provide quenching of the combustion gases 86 in dilution zone 75. The dilution air 82(*c*) flowing through the plurality of dilution openings 68 and through the plurality of dilution openings 69 may also provide turbulence to the flow of combustion gases 86 so as to provide better mixing of the dilution air 82(*c*) with the combustion gases 86. In addition, or, in the alternative, at least a portion of the compressed air 82(*b*) may be routed out of the diffuser cavity 84 for other purposes, such as to provide cooling air to at least one of the HP turbine 28 or the LP turbine 30.

Referring back to FIGS. 1 and 2 collectively, the combustion gases 86 generated in the combustion chamber 62 flow into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsion at the downstream end 99.

Figure 3:
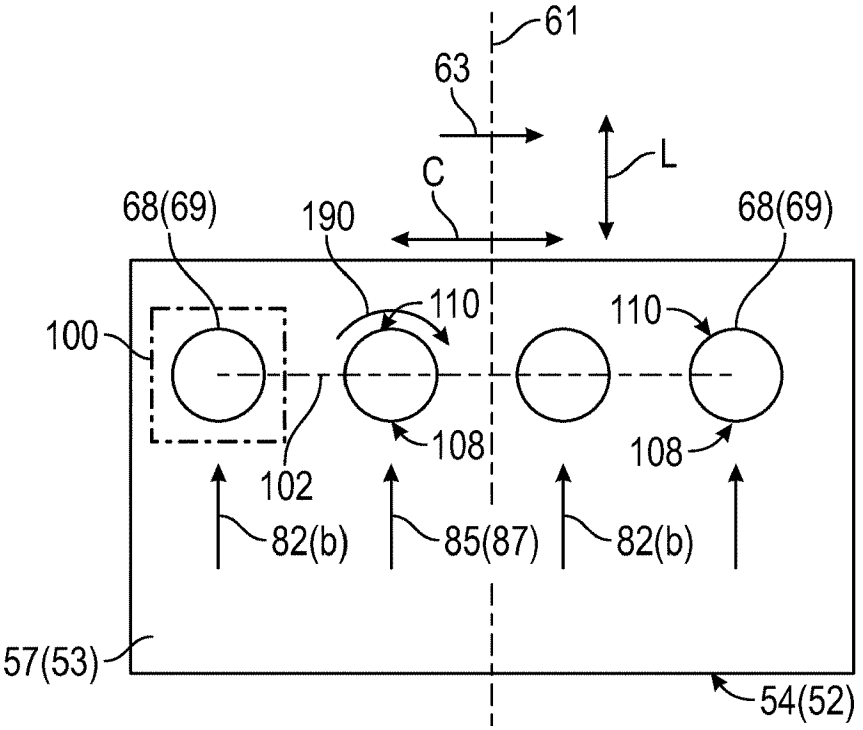
FIG. 3 is a plan view of a cold surface side of a plurality of dilution openings, taken at view A-A of FIG. 2, according to an aspect of the present disclosure.

FIG. 3 is a plan view of a portion of the cold surface side 57 of the plurality of dilution openings 68 through the outer liner 54 taken at view A-A of FIG. 2, according to an aspect of the present disclosure. The arrangement of FIG. 3 is equally applicable to the plurality of dilution openings 69 through the inner liner 52 and, therefore, references to the various inner liner elements may be included in the drawings in parentheses. The following description, however, will be made with regard to the elements of the outer liner 54 for brevity. In FIG. 3, the plurality of dilution openings 68 are shown as being spaced apart from one another in a circumferential direction (C). In addition, as shown in FIG. 3, the plurality of dilution openings 68 are arranged along a same longitudinal location 102 in the longitudinal direction (L) of the outer liner 54. The longitudinal location 102 of the plurality of dilution openings 68 may be a given distance 103 (FIG. 2) from, for example, the dome assembly 56. The compressed air 82(*b*) flowing in the flow direction 85 within the outer flow passage 88 flows across the cold surface side 57 of the outer liner 54, and some of the compressed air 82(*b*) flows through each of the plurality of dilution openings 68 into the combustion chamber 62 as the dilution air 82(*c*) (FIG. 2). With reference to the flow direction 85, the dilution opening 68 includes an upstream side 108 that receives the incoming compressed air 82(*b*) and a downstream side 110.

Figure 4:
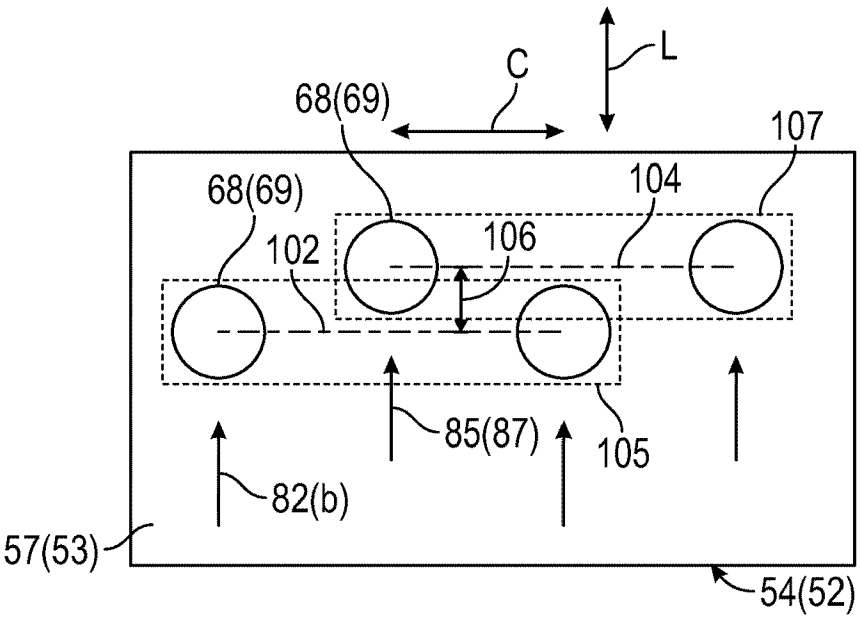
FIG. 4 is an alternative plan view of a cold surface side of a plurality of dilution openings, according to another aspect of the present disclosure.

FIG. 4 illustrates an alternative a plan view to FIG. 3 of the cold surface side 57 of the plurality of dilution openings 68 through the outer liner 54 according to another aspect of the present disclosure. In contrast to the FIG. 3 aspect, in which the plurality of dilution openings 68 are arranged at the same longitudinal location 102, in the FIG. 4 aspect, a first group 105 the plurality of dilution openings 68 may be staggered with respect to a second group 107 of the dilution openings 68. For example, the plurality of dilution openings 68 may be alternately staggered such that the first group 105 of the dilution openings 68 are arranged at a first longitudinal location 102, and the second group 107 of the dilution openings 68 may be arranged at a second longitudinal location 104. The longitudinal location 102 and the second longitudinal location 104 may be offset a given amount 106. In addition, the plurality of dilution openings 68 may be staggered in the circumferential direction (C) in an alternating arrangement.

Figure 5:
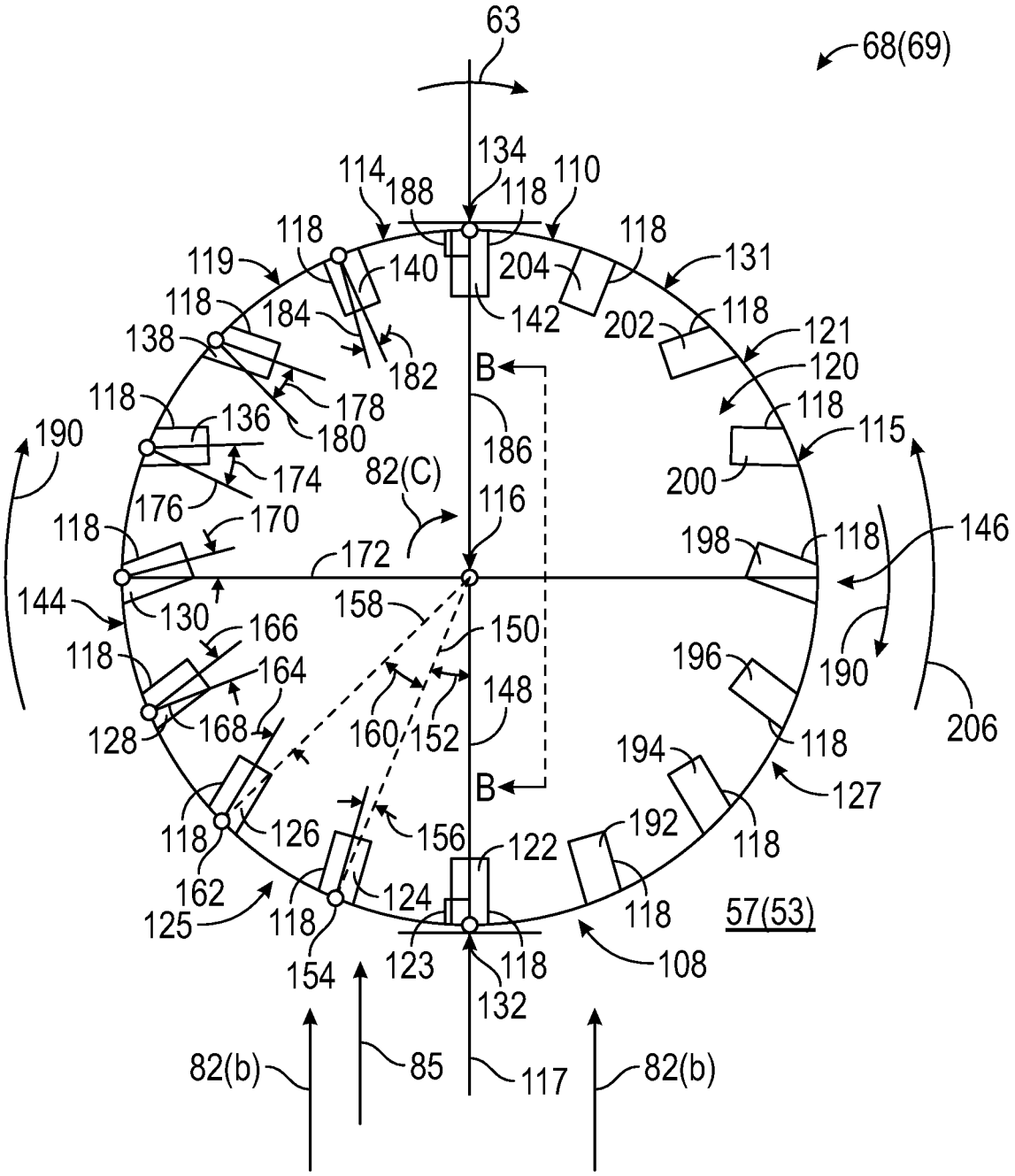
FIG. 5 is an enlarged view of a dilution opening, taken at detail view 100 of FIG. 3, according to an aspect of the present disclosure.
Figure 6:
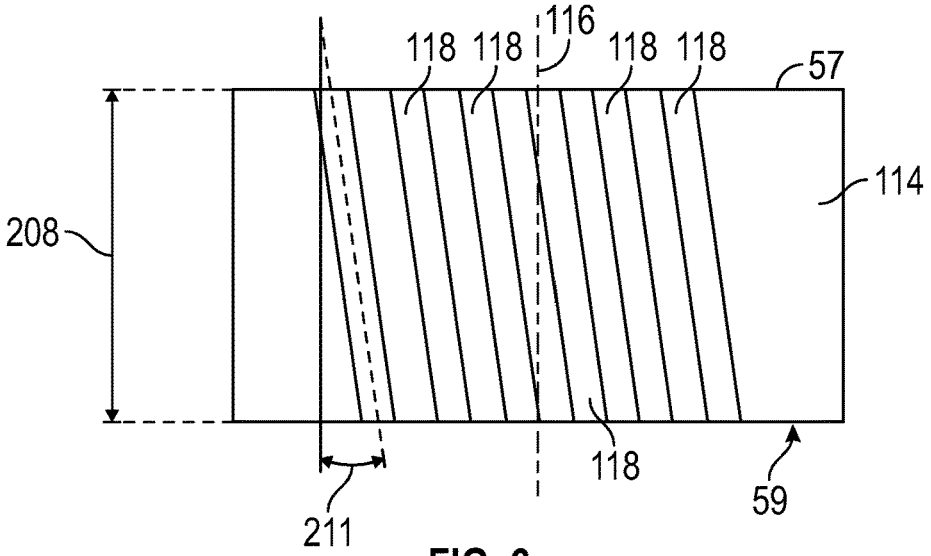
FIG. 6 is a view of an outer wall and swirl vanes, taken at view B-B in FIG. 5, according to an aspect of the present disclosure.

FIG. 5 is an enlarged view of the dilution opening 68 taken at detail view 100 of FIG. 3, according to an aspect of the present disclosure. The dilution opening 68 includes an outer wall 114 that defines an outer circumference 115 of the dilution opening 68. The outer wall 114 extends from the cold surface side 57 of the outer liner 54 to the hot surface side 59 of the outer liner 54 (FIG. 6). The outer wall 114 defines a dilution opening centerline axis 116 through the dilution opening 68. The dilution opening 68 also includes a plurality of swirl vanes 118 extending from the outer wall 114 into a dilution airflow passage 120 that extends through the dilution opening 68. In the case where the inner liner 52 or the outer liner 54 is a single layer liner as shown in FIG. 2, the dilution opening 68 may be formed as a cold chute in which grooves are machined through the liner to form the swirl vanes 118. Alternatively, the dilution opening 68 with the swirl vanes 118 may be formed as a separate grommet that may be inserted into an opening in the liner.

The outer wall 114 further defines a flow direction centerline 117 that extends between an upstream side 108 of the dilution opening 68 and a downstream side 110 of the dilution opening 68. A first circumferential sector 119 is defined about the outer wall 114 on a first side 144 of the dilution opening 68 and a second circumferential sector 121 is defined about the outer wall 114 on a second side 146 of the dilution opening 68 opposite the first side 144 of the dilution opening 68. The plurality of swirl vanes 118 are arranged in a successive arrangement about the outer wall 114 from the upstream side 108 of the dilution opening 68 to the downstream side 110 of the dilution opening 68. For example, when traversing around the outer wall 114 from an upstream-most point 132 to a downstream-most point 134 along the first side 144 of the dilution opening 68, a first swirl vane 122 may be arranged at the upstream-most point 132, and, then, along the outer wall 114 in successive arrangement is a second swirl vane 124, a third swirl vane 126, a fourth swirl vane 128, a fifth swirl vane 130, a sixth swirl vane 136, a seventh swirl vane 138, an eighth swirl vane 140, and a ninth swirl vane 142. The successive arrangement of the second swirl vane 124, the third swirl vane 126, the fourth swirl vane 128, the fifth swirl vane 130, the sixth swirl vane 136, the seventh swirl vane 138, and the eighth swirl vane 140 may be referred to as a first group 125 of swirl vanes. A similar successive arrangement of swirl vanes 118 may also be included when traversing the outer wall 114 from the upstream-most point 132 to the downstream-most point 134 on the second side 146 of the dilution opening 68. The successive arrangement may include a tenth swirl vane 192, an eleventh swirl vane 194, a twelfth swirl vane 196, a thirteenth swirl vane 198, a fourteenth swirl vane 200, a fifteenth swirl vane 202, and a sixteenth swirl vane 204, and may be referred to as a second group 127 of swirl vanes.

For convenience, the outer wall 114 is illustrated as a cylindrical outer wall 131, which defines a dilution hole with a circular cross section. However, the dilution hole can have any desired cross-sectional shape and need not be limited to a circle.

Each of the plurality of swirl vanes 118 extends from the outer wall 114 into the dilution airflow passage 120 at a respective swirl vane angle with respect to the outer wall 114, and successive respective ones of the plurality of swirl vanes 118 extend from the outer wall 114 at a different swirl vane angle. The swirl vane angle for each respective swirl vane may be taken with respect to a line extending from a center of the swirl vane 118 at the outer wall 114 to a radial line emanating from the dilution opening centerline axis 116 and intersecting the outer wall 114 at the same location as the center line for the swirl vane 118. For example, the first swirl vane 122 may be arranged to extend from the outer wall 114 centered at the upstream-most point 132. A first line 148 extending from the upstream-most point 132 to the dilution opening centerline axis 116 is generally parallel to the flow direction 85. The first swirl vane 122 extends from the outer wall 114 at a first swirl vane angle 123, which may be generally perpendicular to the outer wall 114 and, therefore, has a first swirl vane angle 123 with respect to the first line 148 of zero degrees.

The next successive swirl vane, the second swirl vane 124, is arranged on a second line 150 extending between the dilution opening centerline axis 116 to a second point 154 on the outer wall 114, where the second line 150 is angularly offset by an angle 152 with respect to the first line 148. As one example, the angle 152 may be twenty-two and one-half degrees. However, unlike the first swirl vane 122 that extends perpendicularly from the outer wall 114, the second swirl vane 124 extends from the outer wall 114 at a second swirl vane angle 156 with respect to the second line 150. The second swirl vane angle 156 for the second swirl vane 124 may be, for example, fifteen degrees. The next successive swirl vane, the third swirl vane 126, is arranged on a third line 158 extending between the dilution opening centerline axis 116 to a third point 162 on the outer wall 114, where the third line 158 is angularly offset by an angle 160 with respect to the second line 150. As one example, the angle 160 may be twenty-two and one-half degrees. The third swirl vane 126 extends from the outer wall 114 at a third swirl vane angle 164 with respect to the third line 158. The third swirl vane angle 164 for the third swirl vane 126 may be, for example, thirty degrees. Of course, the first swirl vane angle 123, the second swirl angle 156, and the third swirl vane angle 164 are not limited to foregoing exemplary angles and may be arranged at other angles instead. The specific angle selected may be based on, for example, a desired swirl amount or swirl direction of the swirled flow of the dilution air 82(*c*), or the location of the swirl vane along the circumference of the outer wall 114.

For each of the remaining swirl vanes 118, lines similar to the first line 148, the second line 150, and the third line 158 may be included, and each respective line may be arranged at an interval of twenty-two and one-half degrees from the preceding line similar to the angle 152 and the angle 160. Each respective swirl vane 118 is arranged at its own respective swirl vane angle. Thus, for example, the fourth swirl vane 128 is arranged at a fourth swirl vane angle 166 with respect to a fourth line 168, where the fourth swirl vane angle 166 may be, for example, forty degrees. The fifth swirl vane 130 may be arranged at a fifth swirl vane angle 170 with respect to a fifth line 172, where the fifth swirl vane angle 170 may be, for example, forty-five degrees. The sixth swirl vane 136 may be arranged at a sixth swirl vane angle 174 with respect to a sixth line 176, where the sixth swirl vane angle 174 may be, for example, sixty degrees. The seventh swirl vane 138 may be arranged at a seventh swirl vane angle 178 with respect to a seventh line 180, where the seventh swirl vane angle 178 may be, for example, seventy degrees. The eighth swirl vane 140 may be arranged at an eighth swirl vane angle 182 with respect to an eighth line 184, where the eighth swirl vane angle 182 may be, for example, fifteen degrees. The ninth swirl vane 142 may be arranged at a ninth swirl vane angle 188 with respect to a ninth line 186, where the ninth swirl vane angle 188 may be, for example, zero degrees such that the ninth swirl vane 142 extends perpendicularly from the outer wall 114 into the dilution airflow passage 120. Thus, each successive swirl vane 118 in the first group 125 of swirl vanes from the second swirl vane 124 to the eighth swirl vane 140 is arranged at a different swirl vane angle so as to induce a preferential swirl to the flow of dilution air 82(*c*) as it passes through the dilution opening 68. With the foregoing exemplary swirl vane angles, the first group 125 of swirl vanes are configured to induce a preferential swirl in a first swirl direction 190 (i.e., a clockwise flow direction) to the dilution air 82(*c*) passing through the dilution opening 68. The first swirl direction 190 may also be referred to as a dilution opening swirl direction. Referring back to FIG. 3, the dilution opening swirl direction 190 on the downstream side 110 of the dilution opening 68 may be in a same swirl direction as the mixer swirl direction 63.

The plurality of swirl vanes 118 in the second group 127 of swirl vanes arranged along the second side 146 of the dilution opening 68 may be arranged as a mirror image, across the flow direction centerline 117, of the swirl vanes 118 on the first side 144 of the dilution opening 68. For example, the tenth swirl vane 192 may be a mirror image of the second swirl vane 124, the eleventh swirl vane 194 may be a mirror image of the third swirl vane 126, the twelfth swirl vane 196 may be a mirror image of the fourth swirl vane 128, the thirteenth swirl vane 198 may be a mirror image of the fifth swirl vane 130, the fourteenth swirl vane 200 may be a mirror image of the sixth swirl vane 136, the fifteenth swirl vane 202 may be a mirror image of the seventh swirl vane 138, and the sixteenth swirl vane 204 may be a mirror image of the eighth swirl vane 140. Thus, in the mirror image arrangement of the second group 127 of the swirl vanes 118 along the second side 146 of the dilution opening 68, the swirl vanes 118 are arranged at different swirl vane angles so as to induce a preferential swirl of the dilution air 82(*c*) passing through the dilution opening 68 in a second swirl direction 206 that is opposite the first swirl direction 190. Of course, the plurality of swirl vanes 118 in the second group 127 of swirl vanes may be arranged to induce a preferential swirl of the dilution air 82(*c*) passing through the dilution opening 68 in the same direction (i.e., in the first swirl direction 190) as the plurality of swirl vanes 118 in the first group 125 of swirl vanes.

FIG. 6 is a view of the outer wall 114 and swirl vanes 118 taken at view B-B in FIG. 5, according to an aspect of the present disclosure. In FIG. 6, the plurality of swirl vanes 118 are shown as extending along a length 208 of the outer wall 114 from the cold surface side 57 to the hot surface side 59. The plurality of swirl vanes 118 are also seen to extend at an angle 211 between the cold surface side 57 and the hot surface side 59. While FIG. 6 may depict the swirl vanes 118 as being generally linearly angled from the cold surface side 57 to the hot surface side 59, the swirl vanes 118 may instead be formed extending as a spiral vane along the outer wall 114.

Figure 7:
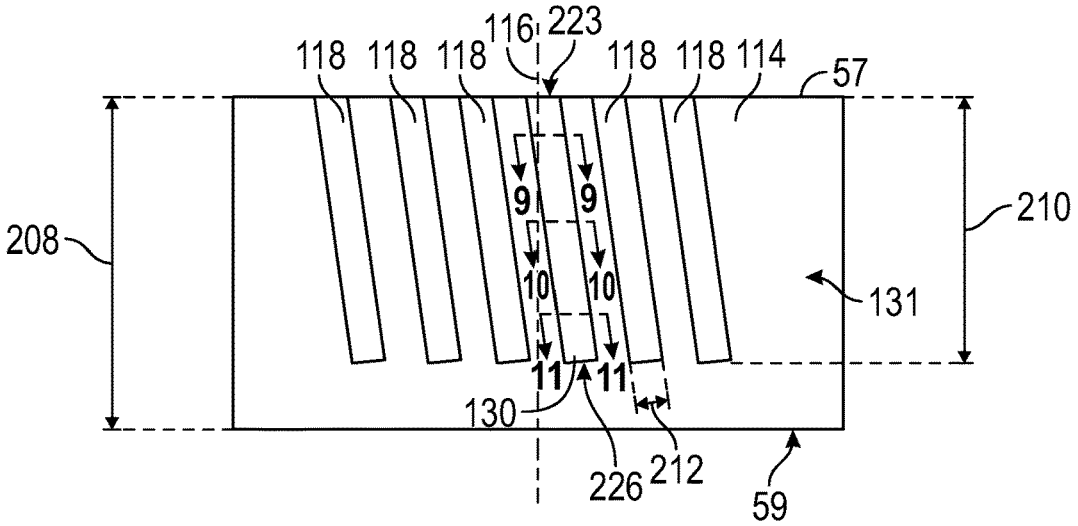
FIG. 7 is a view of an outer wall and swirl vanes, taken at view B-B in FIG. 5 according to another aspect of the present disclosure

FIG. 7 is a view of the outer wall 114 and the swirl vanes 118 taken at view B-B in FIG. 5 according to another aspect of the present disclosure, the swirl vanes 118 may extend partially along the length 208 of the outer wall 114 between the cold surface side 57 and the hot surface side 59. For example, the plurality of swirl vanes 118 may have a length 210 that extends from the cold surface side 57 partially along the length 210 of the outer wall 114 toward the hot surface side 59.

Figure 8:
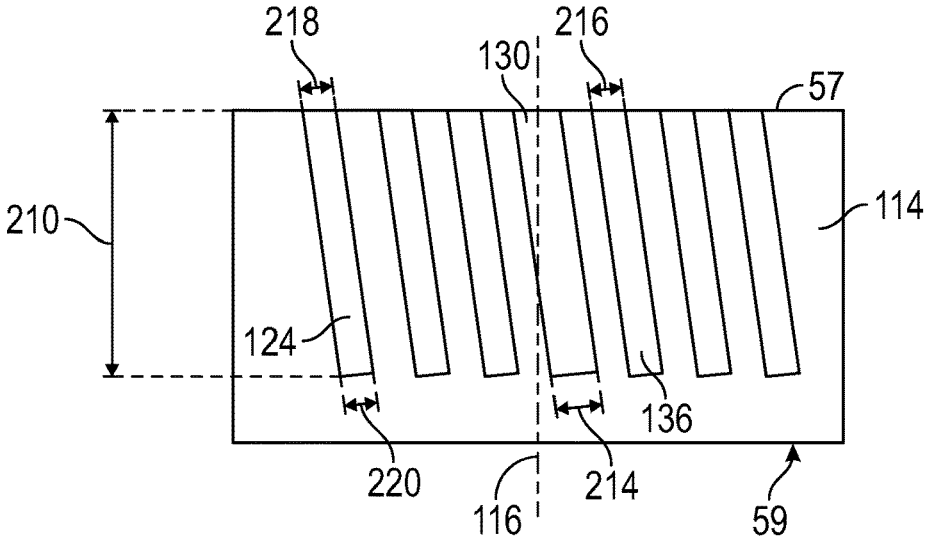
FIG. 8 is a view of an outer wall and swirl vanes, taken at view B-B in FIG. 5, according to still another aspect of the present disclosure.

As also shown in FIG. 7, the swirl vanes 118 may each have a thickness 212, and the thickness 212 of each of the swirl vanes may be the same. Alternatively, as shown in FIG. 8, which is also a view of the outer wall 114 and the swirl vanes 118 taken at view B-B in FIG. 5, the swirl vanes 118 may have different thicknesses. For example, the fifth swirl vane 130 may have a first thickness 214, while the sixth swirl vane 136 may have a second thickness 216 that is less than the first thickness 214. In addition, the thickness of the swirl vanes 118 may vary along the length of the swirl vane 118. For example, the second swirl vane 124 may have a first thickness 218 nearest the cold surface side 57, and may have a second thickness 220 nearest the hot surface side 59, where the first thickness 218 is greater than the second thickness 220. The thickness of the second swirl vane 124 may include a continuous transition between the first thickness 218 to the second thickness 220 along the length 210 of the second swirl vane 124. Of course, the varying thickness along the length of the swirl vane 118 may be implemented for each swirl vane 118, or may be implemented for only some of the swirl vanes 118.

Figure 9:
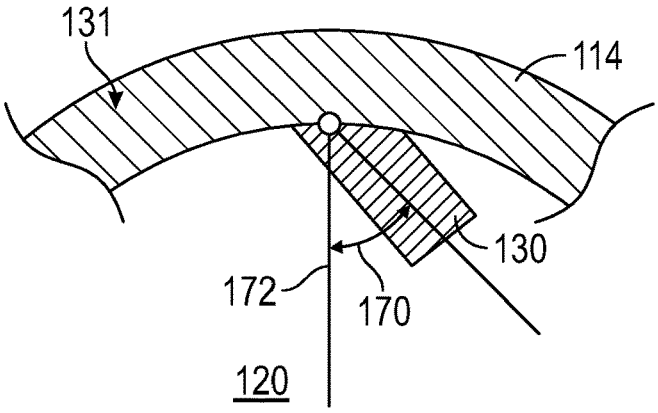
FIG. 9 is a partial cross-sectional view through a swirl vane, taken at plane 9-9 of FIG. 7, according to an aspect of the present disclosure.
Figure 10:
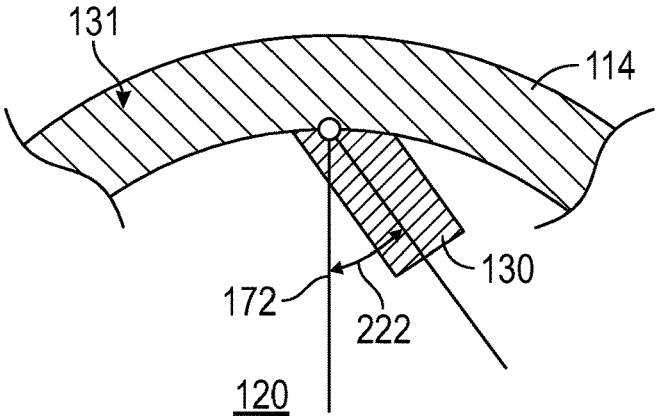
FIG. 10 is a partial cross-sectional view through a swirl vane, taken at plane 10-10 of FIG. 7, according to an aspect of the present disclosure.
Figure 11:
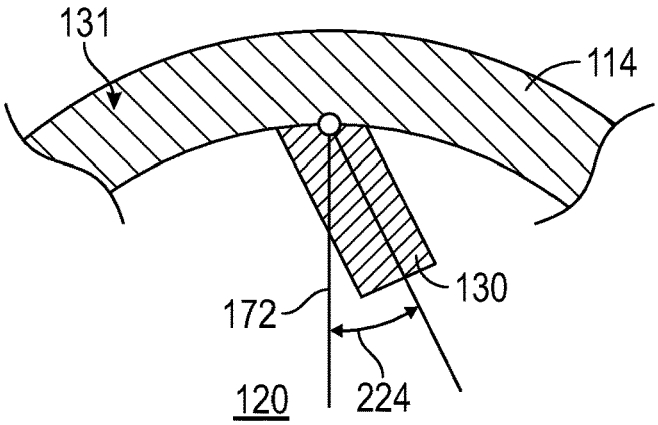
FIG. 11 is a partial cross-sectional view through a swirl vane, taken at plane 11-11 of FIG. 7, according to an aspect of the present disclosure.

In the foregoing description, each swirl vane 118 was described as having a constant swirl vane angle along the length of the swirl vane 118. That is, for example, for the fifth swirl vane 130, the fifth swirl vane angle 170 (FIG. 5) is the same along the length 208 of the swirl vane 118. Referring to FIGS. 9 to 11, a description will now be provided of a swirl vane 118 having a varying swirl vane angle along the length 208 of the swirl vane 118. FIG. 9 is a partial cross section view through the fifth swirl vane 130 taken at plane 9-9 of FIG. 7, nearest a cold surface side end 223 of the fifth swirl vane 130. In the FIG. 9 cross section, the fifth swirl vane 130 is arranged at the fifth swirl vane angle 170, which may be forty-five degrees. FIG. 10 is a partial cross-sectional view taken at plane 10-10 of FIG. 7, which is near a mid-point along the length 208 of the fifth swirl vane 130. In FIG. 10, the fifth swirl vane 130 is seen to be arranged at a swirl vane angle 222, where the swirl vane angle 222 may be, for example, thirty-five degrees. The fifth swirl vane 130 includes a constant transition between the fifth swirl vane angle 170 and the swirl vane angle 222 along the length 208 of the fifth swirl vane 130 between plane 9-9 and plane 10-10. FIG. 11 is a partial cross section view taken at plane 11-11 of FIG. 7, which is nearest a hot surface side end 226 of the fifth swirl vane 130. At plane 11-11, the fifth swirl vane 130 is seen to be arranged at a swirl vane angle 224, which may be, for example, twenty-five degrees. The swirl vane 130 has a constant transition from the swirl vane angle 222 to the swirl vane angle 224 along the length 208 of the fifth swirl vane 130 between the plane 10-10 and the plane 11-11. Thus, the fifth swirl vane 130 transitions from the swirl vane angle 170 (forty-five degrees) at the cold surface side end 223 to the swirl vane angle 224 (twenty-five degrees) at the hot surface side end 226. Any one or more of the swirl vanes 118 may include a varying swirl vane angle along the length 208 of the swirl vane 118.

Figure 12:
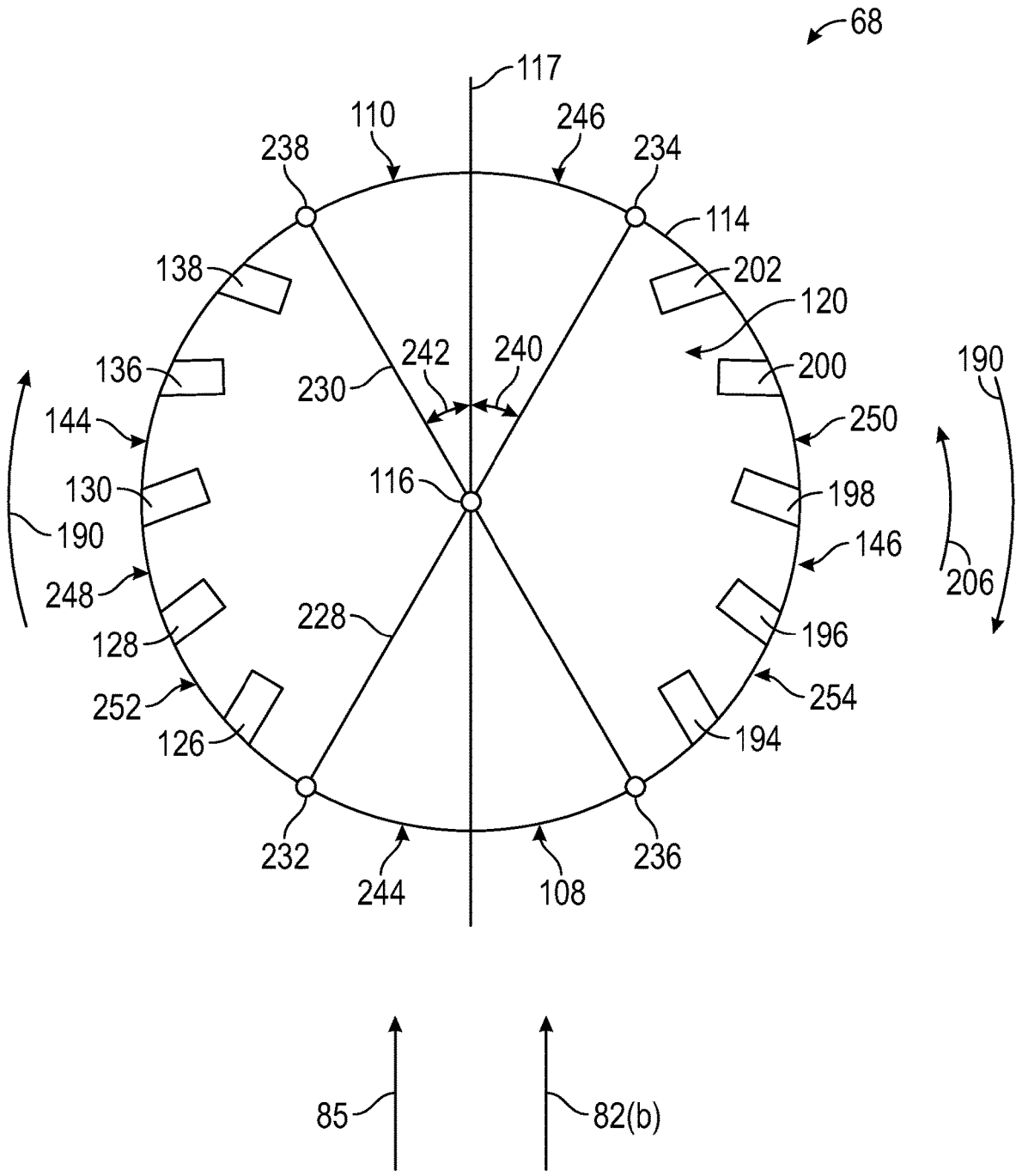
FIG. 12 is an enlarged view of a dilution opening, taken at detail view 100 of FIG. 3, according to still another aspect of the present disclosure.

FIG. 12 is an alternative of the enlarged view of a dilution opening 68 as previously shown in FIG. 5, according to another aspect of the present disclosure. In the same manner as in the FIG. 5 aspect, the outer wall 114 defines the flow direction centerline 117 extending between the upstream side 108 of the dilution opening 68 and the downstream side 110 of the dilution opening 68. In the FIG. 12 aspect, a plurality of sectors may be defined about the circumference of the outer wall 114. For example, four sectors may be defined by a first line 228 and a second line 230. The first line 228 extends across the dilution opening 68 between a first point 232 on the upstream side 108 of the outer wall 114 and a second point 234 on the downstream side 110 of the outer wall 114. The second line 230 extends across the dilution opening between a third point 236 on the upstream side 108 of the outer wall 114 and a fourth point 238 on the downstream side 110 of the outer wall 114. The first line 228 may be offset clockwise from the flow direction centerline 117 by an angle 240 with respect to the dilution opening centerline axis 116, and the angle 240 may be, for example, fifteen degrees. Similarly, the second line 230 may be offset counterclockwise from the flow direction centerline 117 by an angle 242 with respect to the dilution opening centerline axis 116, and the angle 242 may be, for example, fifteen degrees. The first line 228 and the second line 230 define a first sector 244 that extends along the upstream side 108 of the dilution opening 68 between the first point 232 and the third point 236, a second sector 246 that is opposite the first sector 244 and extends along the downstream side 110 of the dilution opening 68 between the second point 234 and the fourth point 238, a third sector 248 that extends between the first sector 244 and the second sector 246 on the first side 144 of the dilution opening 68, and a fourth sector 250 that is opposite the third sector 248 and that extends between the first sector 244 and the second sector 246 on the second side 146 of the dilution opening 68.

In FIG. 12, the first sector 244 is shown as being devoid of the plurality of swirl vanes 118. For example, in comparison to the FIG. 5 aspect, in the FIG. 12 aspect, the upstream side 108 is devoid of the first swirl vane 122, the second swirl vane 124, and the tenth swirl vane 192. Similarly, the second sector 246 is shown as being devoid of the plurality of swirl vanes 118. For example, the downstream side 110 in the FIG. 12 aspect is devoid of the eighth swirl vane 140, the ninth swirl vane 142, and the sixteenth swirl vane 204. By omitting the plurality of swirl vanes 118 on the upstream side 108 and on the downstream side 110, a greater penetration of the dilution air 82(*c*) into the dilution zone 75 of the combustion chamber 62 may be achieved.

On the other hand, a first group 252 of swirl vanes is arranged in the third sector 248, and a second group 254 of swirl vanes arranged in the fourth sector 250. For example, the first group 252 of swirl vanes may include the third swirl vane 126, the fourth swirl vane 128, the fifth swirl vane 130, the sixth swirl vane 136, and the seventh swirl vane 138. The first group 252 of swirl vanes may be configured to induce the swirled flow of dilution air 82(*c*) about the dilution opening centerline axis 116 in the first swirl direction 190. Similarly, the second group 254 of swirl vanes may include the eleventh swirl vane 194, the twelfth swirl vane 196, the thirteenth swirl vane 198, the fourteenth swirl vane 200, and the fifteenth swirl vane 202. The second group 254 of swirl vanes may be configured to induce the swirled flow of the dilution air 82(*c*) about the dilution opening centerline axis 116 in the second swirl direction 206 opposite the first swirl direction 190. Of course, the second group 254 of swirl vanes may be configured to induce the swirled flow of the dilution air 82(*c*) about the dilution opening centerline axis 116 in the first swirl direction 190 (i.e., in the same swirl direction as the first group 252 of swirl vanes).

Figure 13:
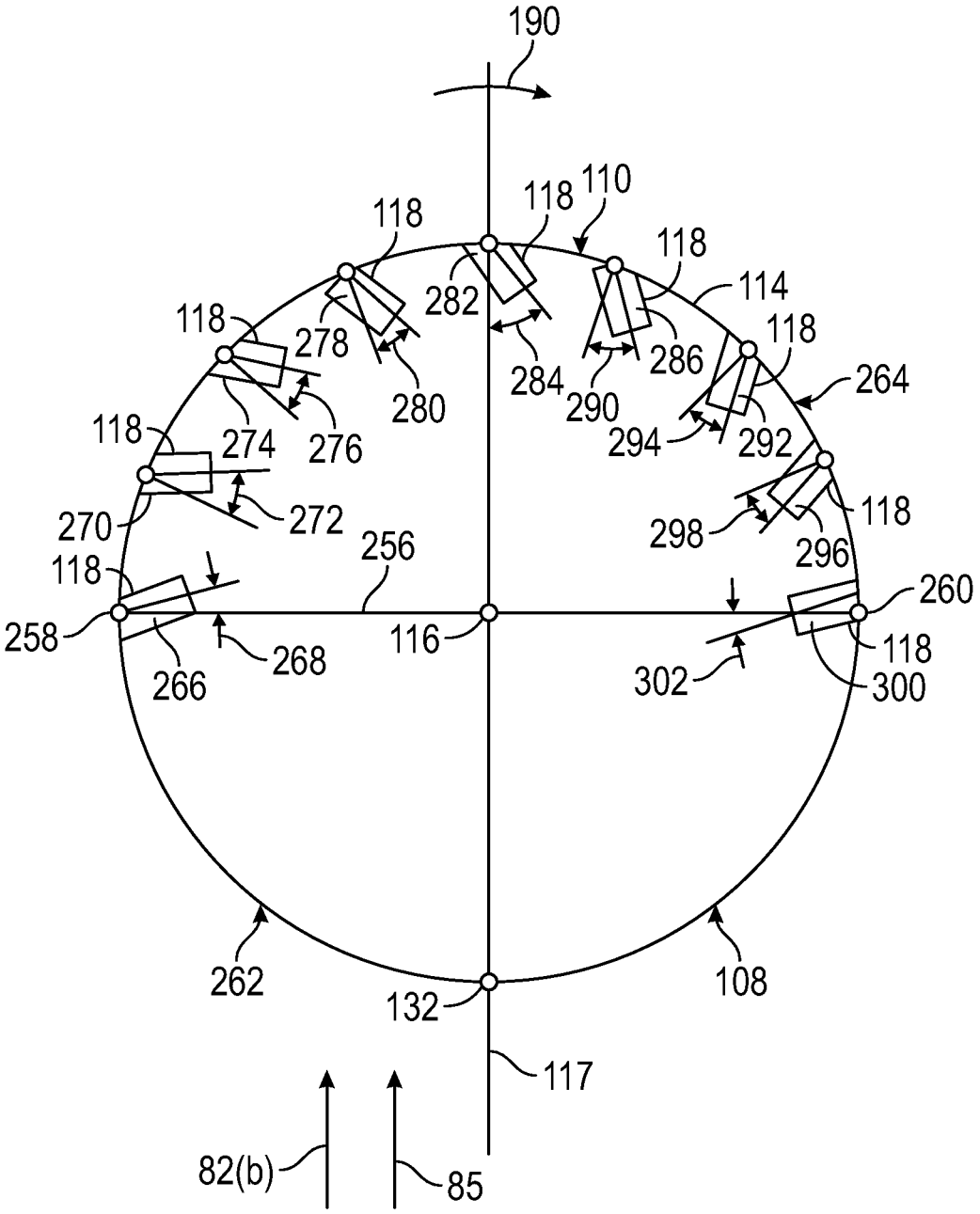
FIG. 13 is an enlarged view of a dilution opening, taken at detail view 100 of FIG. 3, according to yet another aspect of the present disclosure.

FIG. 13 is another alternative of the enlarged view of a dilution opening 68 of FIG. 5, according to yet another aspect of the present disclosure. In the FIG. 13 aspect, a plurality of sectors may be defined about the circumference of the outer wall 114. For example, two sectors may be defined by a line 256 that is generally orthogonal to the flow direction centerline 117 and that extends between a first point 258 on the outer wall 114 and a second point 260 on the outer wall 114. A first sector 262 generally corresponds to an upstream half of the outer wall 114 and a second sector 264 generally corresponds to a downstream half of the outer wall 114. In the FIG. 12 aspect, the first sector 262 may be devoid of the swirl vanes 118, while the second sector 264 may include the plurality of swirl vanes 118. As with the FIG. 5 aspect, each of the swirl vanes 118 is arranged at different respective swirl vane angles. For example, a first swirl vane 266 may be arranged at a first swirl vane angle 268, a second swirl vane 270 may be arranged at a second swirl vane angle 272, a third swirl vane 274 may be arranged at a third swirl vane angle 276, a fourth swirl vane 278 may be arranged at a fourth swirl vane angle 280, a fifth swirl vane 282 may be arranged at a fifth swirl vane angle 284, a sixth swirl vane 286 may be arranged at a sixth swirl vane angle 290, a seventh swirl vane 292 may be arranged at a seventh swirl vane angle 294, an eighth swirl vane 296 may be arranged at an eighth swirl vane angle 298, and a ninth swirl vane 300 may be arranged at a ninth swirl vane angle 302. In the FIG. 13 aspect, the plurality of swirl vanes 118 are arranged to induce a swirled flow of the dilution air 82(*c*) in the first swirl direction 190 about the dilution opening centerline axis 116. Thus, with the first sector 262 on the upstream half of the dilution opening 68 being devoid of the swirl vanes 118, a maximum penetration of the dilution air 82(*c*) into the dilution zone 75 of the combustion chamber 62 can be achieved, while the swirled flow of the dilution air 82(*c*) induced by the swirl vanes 118 in the second sector 264 can fill in the wake region that otherwise occurs at the downstream side 110 at the hot surface side 59 of the outer liner 54.

The foregoing description includes examples of specific swirl vane angles for each of the plurality of swirl vanes, such as the above-described swirl vane angles in FIG. 5 for the first swirl vane angle 123 (zero degrees), the second swirl vane angle 156 (fifteen degrees), the third swirl vane angle 164 (thirty degrees), etc. The specific swirl vane angles, however, are not limited to the exemplary angles described above and may be other angles instead. The specific angle selected may be based on, for example, a desired swirl amount or swirl direction of the swirled flow of the dilution air 82(*c*), or the location of the swirl vane along the circumference of the outer wall 114. As a general example of swirl vane angle ranges for the swirl vanes, referring to the four sectors in FIG. 12, the swirl vanes 118 included in the third sector 248 may be arranged to have a swirl vane angle in a range from thirty degrees to seventy degrees, and the swirl vanes 118 in the fourth sector 250 may be arranged to have a swirl vane angle in a range from minus thirty degrees to minus seventy degrees. In addition, while the first sector 244 and the second sector 246 are shown as being devoid of the swirl vanes, the first swirl vane 122, the second swirl vane 124, and the tenth swirl vane 192 shown in FIG. 5 may be included within the first sector 244, and the swirl vanes 118 included within the first sector 244 may have a swirl vane angle in a range from zero degrees to thirty degrees along a portion of the first sector 244 extending from the flow direction centerline 117 to the first point 232, and may have a swirl vane angle in a range from zero degrees to minus thirty degrees on a portion of the of the first sector 244 extending from the flow direction centerline 117 to the third point 236. Similarly, the second sector 246 may include the eighth swirl vane 140, the ninth swirl vane 142, and the sixteenth swirl vane 204, and the swirl vanes 118 included within the second sector 246 may have a swirl vane angle in a range from zero degrees to thirty degrees along a portion of the second sector 246 extending from the flow direction centerline 117 to the fourth point 238, and may have a swirl vane angle in a range from zero degrees to minus thirty degrees on a portion of the of the second sector 246 extending from the flow direction centerline 117 to the second point 234.

Figure 14:
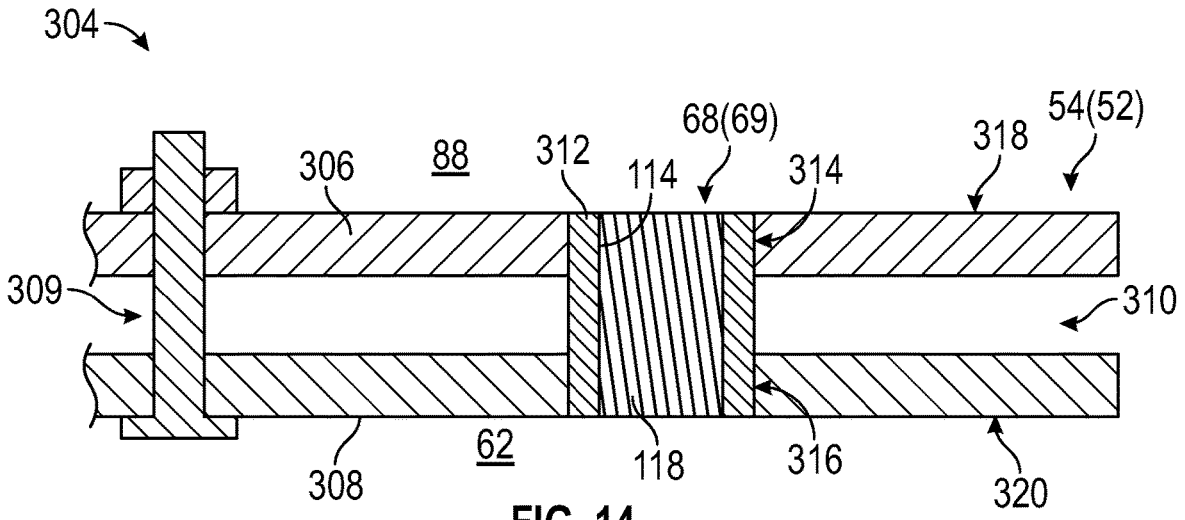
FIG. 14 is an enlarged view of an alternate liner and dilution opening arrangement, taken at detail view 304 of FIG. 2, according to an aspect of the present disclosure.
Figure 15:
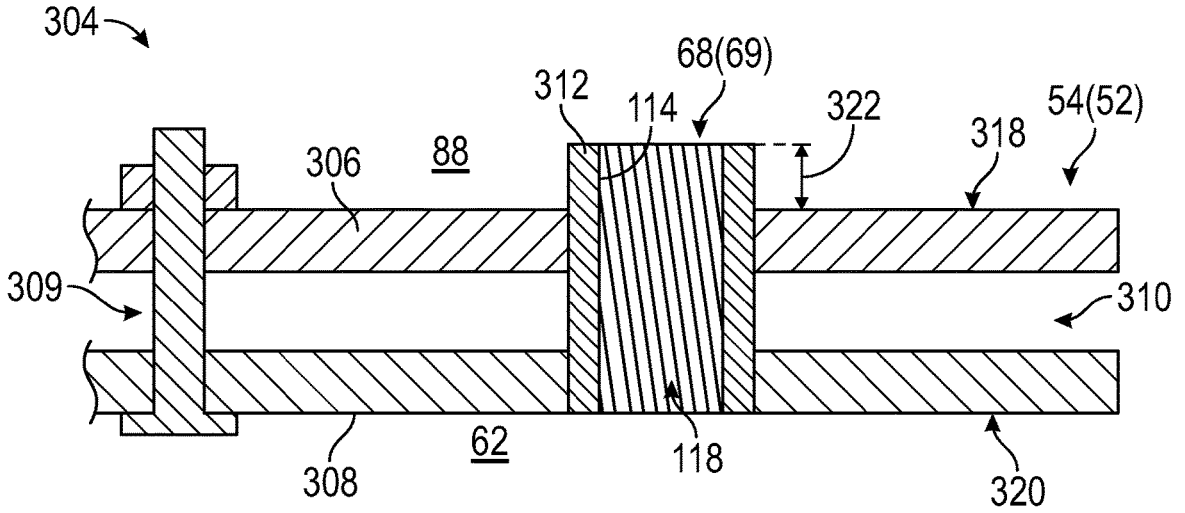
FIG. 15 is an enlarged view of another alternate liner and dilution opening arrangement, taken at detail view 304 of FIG. 2, according to an aspect of the present disclosure.
Figure 16:
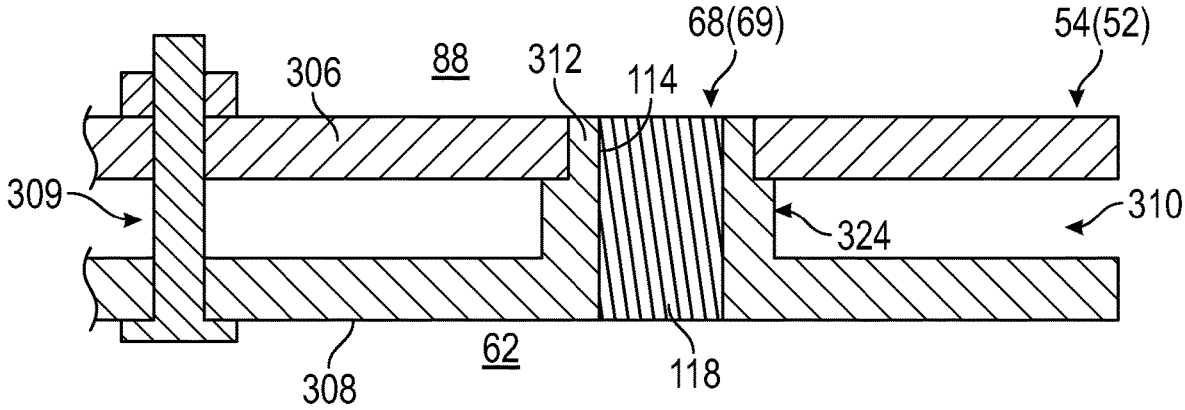
FIG. 16 is an enlarged view of an yet another alternate liner and dilution opening arrangement, taken at detail view 304 of FIG. 2, according to an aspect of the present disclosure.

Each of the foregoing aspects of the dilution opening 68 have been described with regard to the dilution opening 68 being integral with the outer liner 54. However, the plurality of dilution openings 68, and the plurality of dilution openings 69, may be implemented within an insert or a grommet that may be installed in the outer liner 54 or the inner liner 52. In addition, while a single layer outer liner 54 has been described above, the dilution openings 68 may also be implemented in multi-layer liners. FIGS. 14 to 16 depict examples, taken at detail view 304 of FIG. 2, where the dilution opening 68 may be implemented as a grommet in a multi-layer liner. In FIG. 14, outer liner 54 is shown to include an outer shell 306 and an inner tile 308 that may be connected together by a connector 309, such as a bolted connection, to define a cavity 310 therebetween. The dilution opening 68 is implemented as a grommet 312 that may be inserted through an outer shell opening 314 in the outer shell 306 and through an inner tile opening 316 through the inner tile 308. The outer shell 306 includes an outer shell cold surface side 318 and the inner tile 308 includes an inner tile hot surface side 320, and the grommet 312 may be arranged to extend from the outer shell cold surface side 318 to the inner tile hot surface side 320. In an alternative arrangement of the grommet 312 as shown in FIG. 15, the grommet 312 may be arranged to extend a height 322 from the outer shell cold surface side 318 into the outer flow passage 88. In another example depicted in FIG. 16, the grommet 312 may be formed integral with the inner tile 308, and may include a shoulder 324, which may function as a spacer between the outer shell 306 and the inner tile 308. Of course, the grommet 312 cold be formed integral with the outer shell 306 instead.

Further, while the dilution opening 68 has been depicted herein as extending from the cold surface side 57 of the outer liner 54 to the hot surface side 59 of the outer liner 54, when the dilution opening 68 is implemented via an insert, the insert may extend beyond the cold surface side 57 of the outer liner 54 into the outer flow passage 88, or may extend beyond the hot surface side 59 of the outer liner 54 into the dilution zone 75 of the combustion chamber 62.

While the foregoing description relates generally to a gas turbine engine, it can readily be understood that the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Further aspects of the present disclosure are provided by the subject matter of the following clauses.

A combustor liner for a gas turbine, the combustor liner including a liner at least partially defining a combustion chamber, wherein the liner includes a plurality of dilution openings therethrough, each dilution opening of the plurality of dilution openings defined by (a) an outer wall defining an outer perimeter of the dilution opening and defining a dilution opening centerline axis through the dilution opening, and (b) a plurality of swirl vanes extending from the outer wall into a dilution airflow passage that extends through the dilution opening, each of the plurality of swirl vanes extending from the outer wall into the dilution airflow passage at a respective swirl vane angle with respect to the outer wall, the plurality of swirl vanes being arranged in a successive arrangement about the outer wall, and successive respective ones of the plurality of swirl vanes extend from the outer wall at a different swirl vane angle.

The combustor liner according to the preceding clause, wherein the liner includes an inner liner and an outer liner that each extend circumferentially about a combustor centerline axis, and extend in a longitudinal direction along the combustor centerline axis, the plurality of dilution openings being circumferentially spaced apart from one another about the inner liner and about the outer liner.

The combustor liner according to any preceding clause, wherein the plurality of dilution openings include a first group of dilution openings arranged circumferentially at a first longitudinal location along the combustor centerline axis, and a second group of dilution openings arranged circumferentially at a second longitudinal location along the combustor centerline axis.

The combustor liner according to any preceding clause, wherein the liner includes a cold surface side adjacent to an outer flow passage, and a hot surface side adjacent to the combustion chamber, each dilution opening extending from the cold surface side to the hot surface side.

The combustor liner according any preceding clause, wherein the plurality of swirl vanes extend along a length of the outer wall from the cold surface side to the hot surface side.

The combustor liner according to any preceding clause, wherein the plurality of swirl vanes extend along a length of the outer wall between the cold surface side and the hot surface side, and respective ones of the plurality of swirl vanes define a varying swirl vane angle along a length of the swirl vane, the varying swirl vane angle being a first swirl vane angle at a cold surface side of the swirl vane and a second swirl vane angle different from the first swirl vane angle at a hot surface side of the swirl vane.

The combustor liner according to any preceding clause, wherein the plurality of swirl vanes extend partially along a length of the outer wall between the cold surface side and the hot surface side.

The combustor liner according to any preceding clause, wherein the plurality of swirl vanes extend from the cold surface side partially along the length of the outer wall toward the hot surface side.

The combustor liner according to any preceding clause, wherein the outer wall is a cylindrical wall extending from the cold surface side to the hot surface side, and the plurality of swirl vanes extend from the cylindrical wall into the dilution airflow passage.

The combustor liner according to any preceding clause, wherein the outer wall defines a flow direction centerline extending between an upstream side of the dilution opening and a downstream side of the dilution opening, a first sector being defined about the outer wall on a first side of the dilution opening and a second sector being defined about the outer wall on a second side of the dilution opening opposite the first side of the dilution opening, a first group of swirl vanes among the plurality of swirl vanes being arranged in the first sector and being configured to induce a swirled flow of air in a first swirl direction about the dilution opening centerline axis, and a second group of swirl vanes among the plurality of swirl vanes being arranged in the second sector and being configured to induce a swirled flow of air in a second swirl direction about the dilution opening centerline axis.

The combustor liner according to any preceding clause, wherein the first swirl direction and the second swirl direction are a same swirl direction.

The combustor liner according to any preceding clause, wherein the first swirl direction and the second swirl direction are opposite swirl directions.

The combustor liner according to any preceding clause, wherein the outer wall defines a flow direction centerline extending between an upstream side of the dilution opening and a downstream side of the dilution opening, a plurality of sectors being defined about the outer perimeter of the outer wall including a first sector extending along the upstream side of the dilution opening, a second sector opposite the first sector extending along the downstream side of the dilution opening, a third sector extending between the first sector and the second sector on a first side of the dilution opening, and a fourth sector opposite the third sector and extending between the first sector and the second sector on a second side of the dilution opening.

The combustor liner according to any preceding clause, wherein the first sector and the second sector are devoid of the plurality of swirl vanes, and the plurality of swirl vanes are included in the third sector and in the fourth sector.

The combustor liner according to any preceding clause, wherein the plurality of swirl vanes include a first group of swirl vanes arranged in the third sector, and a second group of swirl vanes arranged in the fourth sector, the first group of swirl vanes being configured to induce a swirled flow of dilution air about the dilution opening centerline axis in a first swirl direction, and the second group of swirl vanes being configured to induce a swirled flow of the dilution air about the dilution opening centerline axis in a second swirl direction.

The combustor liner according to any preceding clause, wherein the first swirl direction and the second swirl direction are in a same direction about the dilution opening centerline axis.

The combustor liner according to any preceding clause, wherein the first swirl direction and the second swirl direction are opposite directions about the dilution opening centerline axis.

The combustor liner according to any preceding clause, wherein, in a plan view of a cold surface side of the liner, the dilution opening swirl direction along a downstream side of the dilution opening is a same swirl direction as a mixer swirl direction of a mixer assembly about a mixer assembly centerline axis extending longitudinally through the combustion chamber.

The combustor liner according to any preceding clause, wherein the plurality of swirl vanes extend partially along a length of the outer wall between the cold surface side and the hot surface side, and the plurality of swirl vanes include a varying thickness along a length of the swirl vane.

The combustor liner according to any preceding clause, wherein respective ones of the plurality of swirl vanes have a first thickness at a cold surface side of the swirl vane, and a second thickness different from the first thickness at a hot surface side of the swirl vane.

Although the foregoing description is directed to some exemplary embodiments of the present disclosure, other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A combustor liner for a gas turbine, the combustor liner comprising:

a liner at least partially defining a combustion chamber, wherein the liner includes a plurality of dilution openings therethrough, each dilution opening of the plurality of dilution openings defined by (a) an outer wall defining an outer perimeter of the dilution opening and defining a dilution opening centerline axis through the dilution opening, and (b) a plurality of swirl vanes extending from the outer wall into a dilution airflow passage that extends through the dilution opening, each of the plurality of swirl vanes extending from the outer wall into the dilution airflow passage at a respective swirl vane angle with respect to the outer wall, the plurality of swirl vanes being arranged in a successive arrangement about the outer wall, and successive respective ones of the plurality of swirl vanes extend from the outer wall at a different swirl vane angle.

2. The combustor liner according to claim 1, wherein the liner includes an inner liner and an outer liner that each extend circumferentially about a combustor centerline axis, and extend in a longitudinal direction along the combustor centerline axis, the plurality of dilution openings being circumferentially spaced apart from one another about the inner liner and about the outer liner.

3. The combustor liner according to claim 2, wherein the plurality of dilution openings include a first group of dilution openings arranged circumferentially at a first longitudinal location along the combustor centerline axis, and a second group of dilution openings arranged circumferentially at a second longitudinal location along the combustor centerline axis.

4. The combustor liner according to claim 1, wherein the liner includes a cold surface side adjacent to an outer flow passage, and a hot surface side adjacent to the combustion chamber, each dilution opening extending from the cold surface side to the hot surface side.

5. The combustor liner according claim 4, wherein the plurality of swirl vanes extend along a length of the outer wall from the cold surface side to the hot surface side.

6. The combustor liner according to claim 4, wherein the plurality of swirl vanes extend along a length of the outer wall between the cold surface side and the hot surface side, and respective ones of the plurality of swirl vanes define a varying swirl vane angle along a length of the swirl vane, the varying swirl vane angle being a first swirl vane angle at a cold surface side of the swirl vane and a second swirl vane angle different from the first swirl vane angle at a hot surface side of the swirl vane.

7. The combustor liner according to claim 4, wherein the plurality of swirl vanes extend partially along a length of the outer wall between the cold surface side and the hot surface side.

8. The combustor liner according to claim 7, wherein the plurality of swirl vanes extend from the cold surface side partially along the length of the outer wall toward the hot surface side.

9. The combustor liner according to claim 4, wherein the outer wall is a cylindrical wall extending from the cold surface side to the hot surface side, and the plurality of swirl vanes extend from the cylindrical wall into the dilution airflow passage.

10. The combustor liner according to claim 1, wherein the outer wall defines a flow direction centerline extending between an upstream side of the dilution opening and a downstream side of the dilution opening, a first sector being defined about the outer wall on a first side of the dilution opening and a second sector being defined about the outer wall on a second side of the dilution opening opposite the first side of the dilution opening, a first group of swirl vanes among the plurality of swirl vanes being arranged in the first sector and being configured to induce a swirled flow of air in a first swirl direction about the dilution opening centerline axis, and a second group of swirl vanes among the plurality of swirl vanes being arranged in the second sector and being configured to induce a swirled flow of air in a second swirl direction about the dilution opening centerline axis.

11. The combustor liner according to claim 10, wherein the first swirl direction and the second swirl direction are a same swirl direction.

12. The combustor liner according to claim 10, wherein the first swirl direction and the second swirl direction are opposite swirl directions.

13. The combustor liner according to claim 1, wherein the outer wall defines a flow direction centerline extending between an upstream side of the dilution opening and a downstream side of the dilution opening, a plurality of sectors being defined about the outer perimeter of the outer wall including a first sector extending along the upstream side of the dilution opening, a second sector opposite the first sector extending along the downstream side of the dilution opening, a third sector extending between the first sector and the second sector on a first side of the dilution opening, and a fourth sector opposite the third sector and extending between the first sector and the second sector on a second side of the dilution opening.

14. The combustor liner according to claim 13, wherein the first sector and the second sector are devoid of the plurality of swirl vanes, and the plurality of swirl vanes are included in the third sector and in the fourth sector.

15. The combustor liner according to claim 14, wherein the plurality of swirl vanes include a first group of swirl vanes arranged in the third sector, and a second group of swirl vanes arranged in the fourth sector, the first group of swirl vanes being configured to induce a swirled flow of dilution air about the dilution opening centerline axis in a first swirl direction, and the second group of swirl vanes being configured to induce a swirled flow of the dilution air about the dilution opening centerline axis in a second swirl direction.

16. The combustor liner according to claim 15, wherein the first swirl direction and the second swirl direction are in a same direction about the dilution opening centerline axis.

17. The combustor liner according to claim 15, wherein the first swirl direction and the second swirl direction are opposite directions about the dilution opening centerline axis.

18. The combustor liner according to claim 16, wherein, in a plan view of a cold surface side of the liner, a dilution opening swirl direction along the downstream side of the dilution opening is a same swirl direction as a mixer swirl direction of a mixer assembly about a mixer assembly centerline axis extending longitudinally through the combustion chamber.

19. The combustor liner according to claim 4, wherein the plurality of swirl vanes extend partially along a length of the outer wall between the cold surface side and the hot surface side, and the plurality of swirl vanes include a varying thickness along a length of the swirl vane.

20. The combustor liner according to claim 19, wherein respective ones of the plurality of swirl vanes have a first thickness at a cold surface side of the swirl vane, and a second thickness different from the first thickness at a hot surface side of the swirl vane.

* * * * *